US005402455A

United States Patent [19]

Angelo, II et al.

[11] Patent Number: 5,402,455

[45] Date of Patent: Mar. 28, 1995

[54] WASTE CONTAINMENT COMPOSITE

[75] Inventors: James F. Angelo, II, Richland, Wash.; James T. Pride, Oak Ridge, Tenn.; Thomas S. Snyder, Oakmont, Pa.

[73] Assignee: Westinghouse Electric Corporation, Pittsburgh, Pa.

[21] Appl. No.: 177,902

[22] Filed: Jan. 6, 1994

[51] Int. Cl.[6] ..... G21F 9/22; G21F 1/04

[52] U.S. Cl. ..... 376/272; 376/288; 250/515.1; 588/3

[58] Field of Search ..... 376/272, 287, 288; 250/506.1, 507.1, 515.1, 517.1, 519.1; 252/478, 633; 588/3, 4

[56] References Cited

U.S. PATENT DOCUMENTS

| | | | |
|---|---|---|---|
| 3,922,413 | 11/1975 | Reineman | 428/413 |
| 4,137,088 | 1/1979 | Debus et al. | 106/90 |
| 4,257,912 | 3/1981 | Fleischer et al. | 252/633 |
| 4,633,091 | 12/1986 | Kurasch et al. | 250/506.1 |
| 4,781,883 | 11/1988 | Daugherty et al. | 376/272 |
| 4,845,372 | 7/1989 | Mallory et al. | 250/506.1 |
| 4,910,076 | 3/1990 | Ando et al. | 428/245 |
| 4,926,046 | 5/1990 | Roy et al. | 250/506.1 |
| 4,950,426 | 8/1990 | Markowitz et al. | 252/633 |
| 5,002,610 | 3/1991 | Sherif et al. | 106/691 |
| 5,102,615 | 4/1992 | Grande et al. | 376/272 |

*Primary Examiner*—Daniel D. Wasil
*Attorney, Agent, or Firm*—Daniel P. Cillo

[57] ABSTRACT

The present invention provides an improved multilayered storage structure composite material. The composite contains a fibrous mat made from interwoven fibers, preferably metallic fibers, that is encased with a concrete-based mixture to form a mat layer. At least one concrete-based layer is also disposed within the composite, and this concrete-based layer preferably contains at least one shielding additive. The composite material is preferably formed into a containment vessel for the storage of hazardous, radioactive, and mixed waste materials.

26 Claims, 3 Drawing Sheets

WASTE CONTAINMENT COMPOSITE

FIELD OF THE INVENTION

The present invention relates to a composite material having use in containment systems and container vessels for storage of waste materials. More specifically, the invention relates to containment systems and container vessels for storage of hazardous, radioactive, or mixed wastes wherein the system or vessel is fabricated with a multilayered structure including a fibrous mat layer.

BACKGROUND OF THE INVENTION

Containment systems employing various composite structures have been developed to handle waste materials. The waste materials to which this invention is concerned are primarily hazardous, radioactive, and mixed, that is both hazardous and radioactive, wastes. These containment systems must meet rigid governmental safety standards set for structural stability and strength, along with those for its shielding characteristics.

Conventionally, these containment systems have been made with composite materials having concrete layers, optionally reinforced with metal bars such as a rebar construction to improve the strength of the container. Examples of such systems are generally shown in U.S. Pat. Nos. 4,950,246 and 4,845,372. These systems have been widely used and accepted by the industry, however improvements upon these designs can be made to improve their strength and shielding capacity.

SUMMARY OF THE INVENTION

The present invention provides an improved shielding composite material having a multiple layered construction. The composite contains a fibrous mat layer that has a first and a second face. The mat layer contains a mat that is made from interwoven fibers, preferably metallic fibers, and these fibers are encased within a concrete-based material. A first concrete-based layer is located proximate to at least one face, and optionally both faces, of the mat layer. The concrete-based layer preferably contains at least one shielding additive such as barite, magnetite, taconite, depleted uranium, vitrified glass-like materials manufactured from thermal treatment of wastes, and mixtures thereof.

An impermeable coating layer is optionally placed on the exposed face of either concrete-based layer to prevent liquids and other fluids from contacting the concrete-based layers.

The mat layer, composed of the fibrous mat and solidified in the concrete-based material, improves both the strength of the layered storage composite, but also improves its shielding capacity in comparison to a similar composite made with concrete, or concrete with a rebar construction.

The present invention also provides methods for constructing the multi-layered storage structure composite. The fibrous mat containing the interwoven fibers is provided such that a first and second face are exposed. A concrete-based mixture is then poured into and adjacent to the mat to encase the fibers of the mat in the concrete-based mixture and to provide a first concrete-based layer proximate to the first face of the mat. The concrete-based mixture preferably contains at least one shielding additive.

DETAILED DESCRIPTION OF THE INVENTION

The present invention provides improved layered storage structure composites for use in the storage of waste materials, especially hazardous, radioactive, and mixed waste materials. The composites can be used to form containment systems, container vessels, shielding structures, and containment storage areas, all of which are used to house in some manner waste materials. The composite has within its structure a mat that provides improved structural support along with improved radioactive shielding in comparison with other composites that employ concrete mixes with or without metal rebar materials for imparting strength to the composite. The preferred use for the composite is to form a container vessel in which waste materials are placed for storage.

The composite material of the present invention contains a fibrous mat layer that is prepared with a concrete-based material within its matrix. The combination of the fibrous mat, preferably made of metal fibers, and the concrete-based material that fills the void spaces within the mat matrix, provides for both a superior strength and shielding composite material for a containment system or container vessel.

Figure 1:
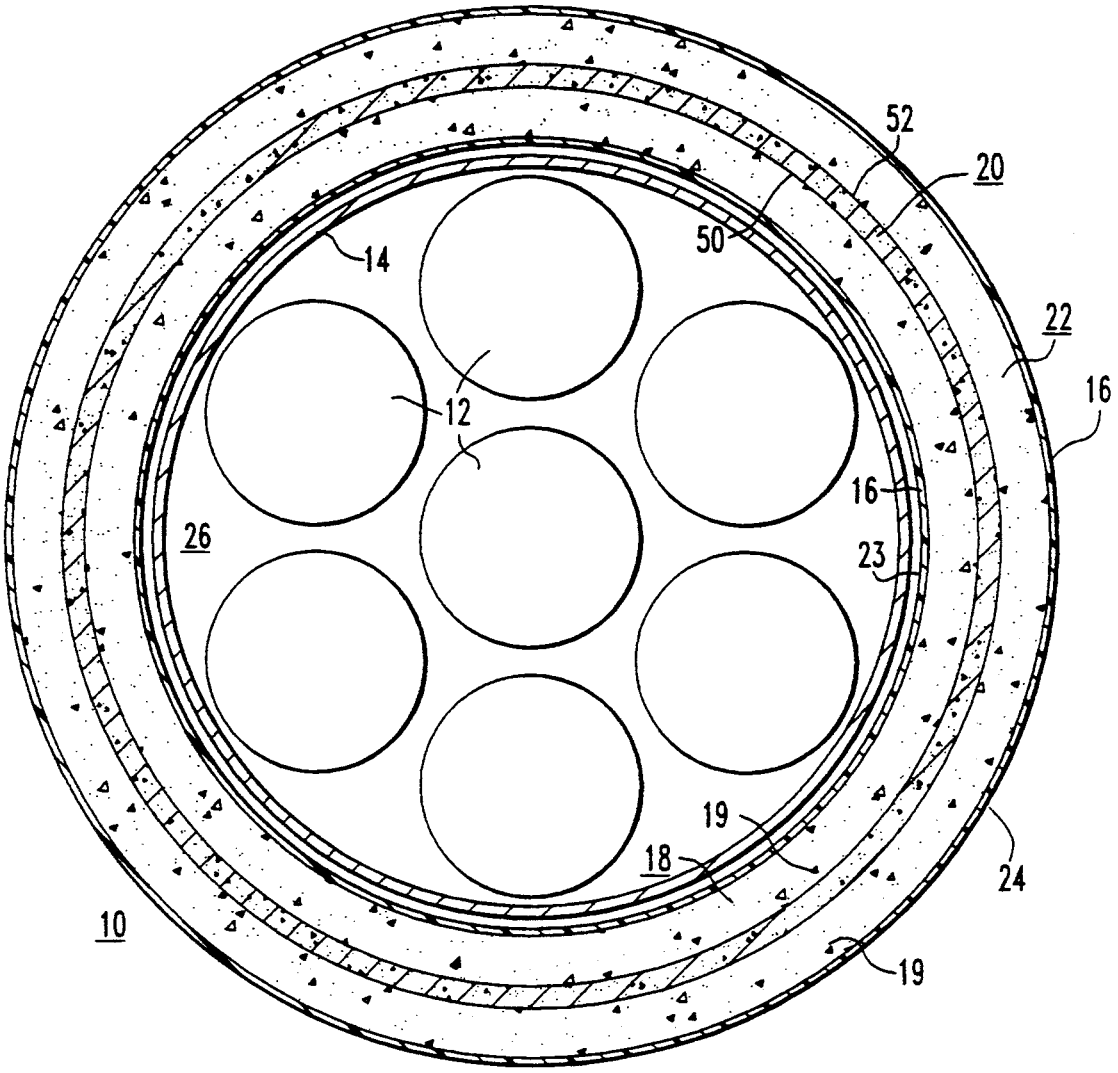
FIG. 1 is a cross-sectional view of a containment vessel made from the composite material of the present invention.
Figure 2:
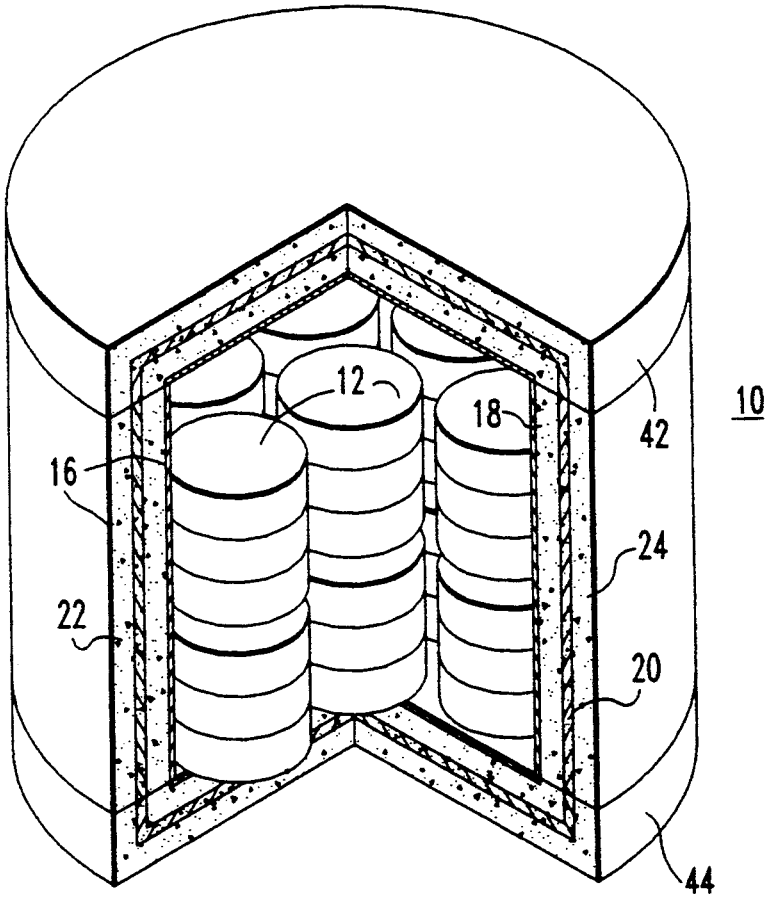
FIG. 2 is a partially isometric view of a containment vessel made from the composite material of the present invention.

An embodiment of the invention is depicted in FIGS. 1 and 2 which shows a container vessel 10 in cross-sectional and isometric views. The vessel 10 is used to store waste containers 12 that contain waste materials such as hazardous, radioactive, or mixed waste materials. The vessel 10 is made of the composite layered structure of the present invention. The vessel 10 is outfitted with a mat 20. The mat 20 preferably encompasses the containers 12 along the entire periphery of the area 26 in which the containers are housed. In certain embodiments, a portion of the area 26 can be exposed, or not encompassed by the mat 20, such as the top wall 42 or floor 44 of the vessel 10 as shown in FIG. 2. Preferably, the top wall 42 and floor 44 are made of the same composite layered structure as the rest of the vessel 10.

The vessel 10 can have a multitude of geometries. For instance, the vessel 10 can be round, square, or hexagonal among others. Such configurations allow for various packing and storing configurations dependent upon the containment system.

Figure 3:
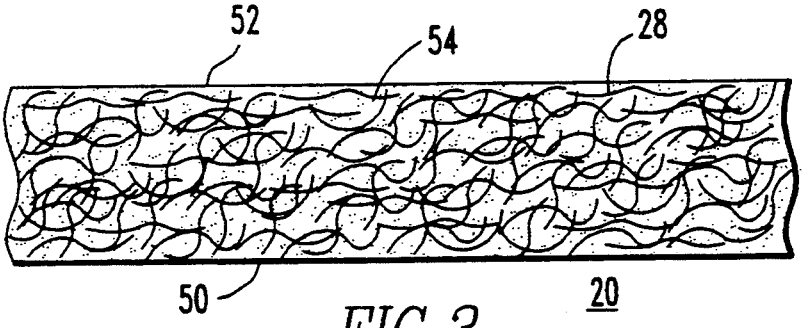
FIG. 3 is a cross-sectional view of the mat layer of the composite material of the present invention.

The mat 20 is an interwoven matrix of fibrous materials and is shown in more detail in a general cross-sectional view in FIG. 3. The fibers 28 can be made of plastic, ceramic, or metal, such materials that are recycled, or mixtures thereof, and is preferably made of metal fibers such as steel or lead, more preferably stainless steel. The mat 20 is constructed in such a way that the fibers are interwoven to create a tightly woven mesh pad having a thickness of from about 0.6 cm (0.25 in.) to about 10 cm (4 in.), preferably from about 1.2 cm (0.5 in.) to about 7.6 cm (3 in.), more preferably from about 2.5 cm (1 in.) to about 5 cm (2 in.). The individual fibers 28 that constitute the mat 20 are generally from about 10 to about 100 μm, preferably from about 20 to about 60 μm, and more preferably from about 25 to about 40 μm in thickness. The fibers 28 are encased in the concrete 54 matrix.

The mat 20 is free-standing in that the interwoven fibers 28 provide support for the mat 20 and the mat 20 can be handled without the fibers 28 becoming disassociated with the mat 20 to a substantial degree. The mat 20 has a fiber volume of from about 1 to about 10, preferably from about 1 to about 5, and more preferably from about 1.5 to about 3, volume percent. An example of such a mat is commercially available from Ribbon Technology Corporation, Gahanna, Ohio.

Referring back to FIG. 1, the composite material of which vessel 10 is constructed has at least one layer of support material proximate to the mat 20 to provide both support to the vessel 10 and also for shielding purposes. This layer can be positioned either proximate to the inner face 50 or outer face 52 of the mat 20, preferably proximate to the outer face 52 of the mat 20. Vessel 10 is shown with such an outer layer 22 and with an optional inner layer 18. These layers 18,22 can vary in thickness according to the strength and shielding requirements of the vessel 10, however they are generally from about 2.5 cm (1 in.) to about 15 cm (10 in.), preferably from about 2.5 cm (1 in.) to about 10 cm (4 in.).

The layers 18,22 are preferably grout- or concrete-based materials. These materials can include, as dispersed shielding enhancement additives 19, such materials as barite, magnetite, taconite, depleted uranium, and vitrified glass-like materials such as vitrified ash products along with mixtures of these additives. Preferred additives 19 include barite and magnetite. These additives can be admixed with the concrete materials up to about 75, preferably from about 25 to about 75, and more preferably from about 45 to about 70, weight percent. The additives 19 generally are from about 0.5 cm (0.19 in.) to about 1.3 cm (0.5 in.) in particle size, and preferably less than about 5 percent by weight of the additives are below about 100 μm particle size.

The vessel 10 is manufactured by positioning the mat 20 into a form and pouring the materials constituting the layer 18 or 22 against the mat 20. The preferred materials for the layer 18 or 22 is a concrete-based mixture containing at least one of the additives 19. It is preferred to limit the amount of water used in the concrete mixture, replacing the water with plasticizer, or superplasticizer, materials. Plasticizers are commonly used materials in the concrete industry and generally extend the slump retention of the concrete mixture, such plasticizers are commercially available from Master Builders, Inc., Cleveland, Ohio as RHEOBUILD 1000 plasticizer. The plasticizers are commonly salts, either calcium or sodium, of beta-naphthalene sulfonate polymers that enable the concrete mixture to meet the ASTM C494 type F concrete specification.

It is also preferred to limit the amount of small particle size materials, or "sand-like" particles, in the concrete mixture used for layers 18,22. The amount of particles having a particle size of below about 500 μm, preferably below about 100 μm is below about 10, more preferably below about 5, weight percent of the materials constituting the concrete-based mixture. The concrete-based mixture preferably does not contain sand. These steps are taken to assure that the concrete-based mixture thoroughly permeates the mat 20 matrix, filling the void spaces within the mat 20, and thus producing a sol id cast matrix. Generally, the concrete-based mixture fills at least about 50, preferably at least about 80, and more preferably at least about 95, percent by volume of the void space within the mat 20.

The concrete-based mixture generally contains from about 15 to about 40, preferably from about 20 to about 30, weight percent cement; from about 5 to about 15, preferably from about 8 to about 12, weight percent water; from about 10 to about 15 percent by weight fly ash; and at least about 0.5, preferably from about 0.5 to about 0.1, and more preferably from about 0.52 to about 0.8, percent by weight of plasticizer.

The concrete-based mixture preferably also contains metallic fibers dispersed within the mixture. These fibers are provided in loose, individual form and can be made from such materials, for example, as steel, including stainless and carbon-coated, along with lead and other metallic materials and their oxides, carbon, and graphite and can further be made of recycled materials of any kind. The fibers are generally about 15 mm (0.62 in.) to about 5 cm (2 in.) in length, about 1–2 mm (0.04–0.08 in.) in width, and about 30 μm in thickness. These metallic fibers are provided in an amount of from about 0.5 to about 3 percent by weight of the concrete-based mixture. These fibers are commercially available from Ribbon Technology Corporation. The incorporation of the fibers provides for an increase strength composite material. The fibers incorporate themselves into the mat 20 matrix during the process of pouring the concrete-based materials.

The concrete-based mixture can also contain other materials such as zeolites, activated carbon, sodium silicate, or silica fume, or mixtures thereof. These materials improve the strength and shielding of the composite.

The concrete-based mixture is positioned into the mat 20 matrix by the use of vibrators. The larger particle size additives 19 generally cannot enter into the mat 20 matrix, however the concrete mix is made with such a fluidity characteristic that the other concrete-based mixture components are carried into the matrix.

The vessel 10 can optionally be manufactured with a inner wall 23 and outer wall 24 that are coated with an impermeable material layer 16. Typical impermeable materials include glass coatings, epoxy coatings, and inorganic coatings such as those containing silica and zirconia. This coating is from about 0.3 cm (0.1 in.) to about 0.6 cm (0.25 in.) in thickness.

A further optional layer of the vessel 10 can be a liner 14. The liner 14 is located adjacent to the inner wall 23 and can be made from such materials as steel, lead, and depleted uranium.

Figure 4:
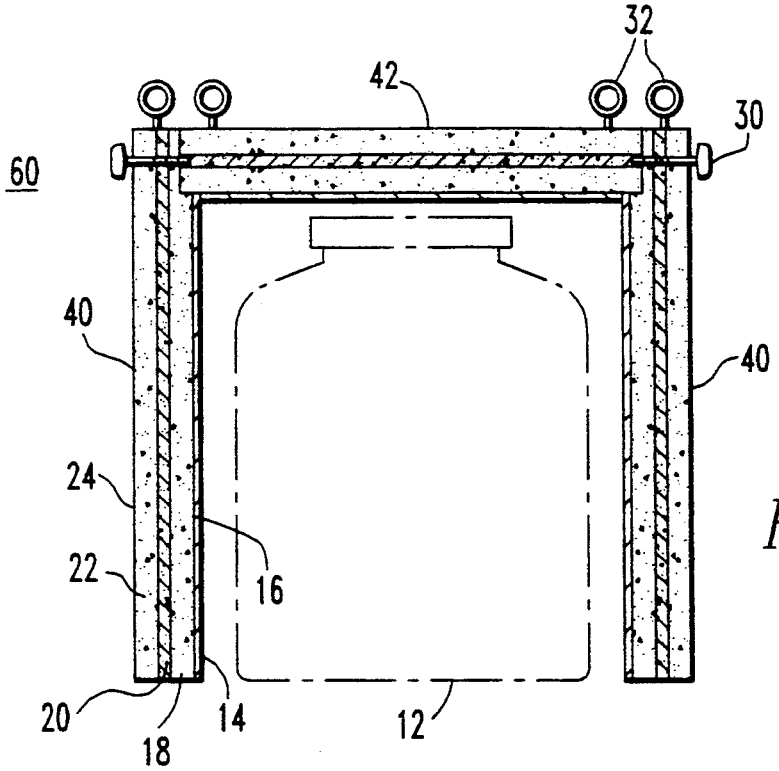
FIG. 4 is a cross-sectional view of a containment system made from the composite material of the present invention.

The various layers that constitute the vessel 10 can also be used for storing purposes in various shapes besides those employed as a vessel. For instance, the layer construction of the present invention can be used to encase several high integrity containers placed in a series or row formation. For instance, in FIG. 4 a cross-sectional view is shown depicting the composite layer structure of the present invention used as a shielding containment system 60. The side walls 40 and top wall 42 are set into place by means of the lugs 32 and held together by means of a bolt 30. In this way, several containers 12 can be set along side one another and the layered shielding walls extended to ensure proper storage.

Figure 5:
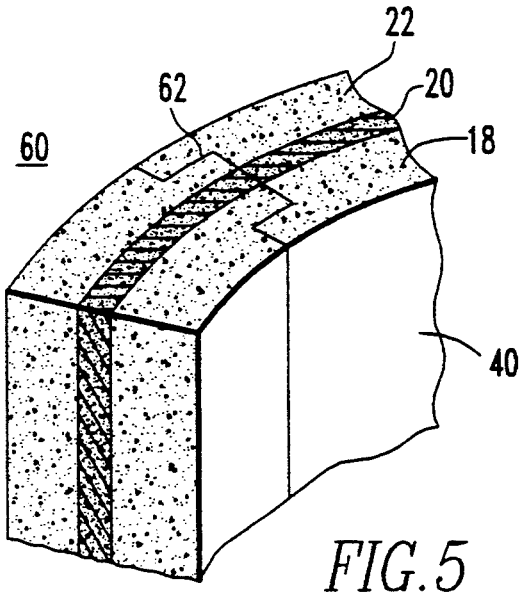
FIG. 5 is an isometric view of a containment system of the present invention.

The walls 40,42 of the containment system 60 are typically formed as individual units and must be connected to form an entire containment system 60. As shown in FIG. 5, the walls, such as side wall 40, are interconnected by the use of a joint 62 that is preferably a labyrinth or off-set joint to reduce the streaming of hazardous or radioactive fumes.

The improved composite layered structure of the present invention described above can thus be described as having an optional first layer that is the liner 14. Positioned proximate to the liner 14 is an optional impermeable coating 16. Adjacent to the coating 16 is a first concrete-based layer, or inner layer 18, which is located proximate to the mat 20. On the other side of the mat 20 is a second concrete-based layer 22 upon which an optional impermeable layer 16 can be placed. This multilayered composite material displays improved strength and shielding capacity than conventional composite materials which do not contain such a fibrous mat.

It is claimed:

1. An improved shielding composite comprising:

(a) a fibrous mat layer having a first and second face, the mat layer comprising a mat having, a thickness of from 1.2 cm (0.5 in.) to 10 cm (4 in.) and comprising an interwoven matrix of metal fibers effective to provide a radioactive shielding effect and a concrete-based material encasing the fibers and permeating the matrix, and filling at least 50 percent by volume of the void spaces within the matrix;

(b) a first concrete-based layer located proximate to the first face of the mat layer, and (c) a second concrete-based layer located proximate to the second face of the mat layer.

2. The composite of claim 1 wherein the first concrete-based layer further comprises at least one additive selected from the group consisting of barite, magnetite, taconite, depleted uranium, vitrified glass-like materials, and mixtures of these additives.

3. The composite of claim 2 further comprising an impermeable coating layer located adjacent to the first concrete layer.

4. The composite of claim 1 wherein the interwoven fibers have a thickness of from about 10 to about 100 μm.

5. The composite of claim 2 wherein the second concrete-based layer further comprises at least one additive selected from the group consisting of barite, magnetite, taconite, depleted uranium, vitrified glass-like materials, and mixtures thereof.

6. The composite of claim 5 further comprising an impermeable coating layer located adjacent to the second concrete layer.

7. The composite of claim 1 wherein the mat layer has a thickness of from about 2.5 cm (1 in.) to about 5 cm (2 in.), the mat has a fiber volume of from about 1 volume percent to about 10 volume percent, the concrete-based material encasing the fibers and permeating the matrix fills at least 80 percent by volume of the void spaces within the matrix and contains only up to 10 weight percent of particulate material below about 500 μm, and where the composite comprises shielding for radioactive waste materials.

8. A method of constructing a containment storage structure comprising:

(a) providing a mat having a thickness of from 1.2 cm (0.5 in.) to 10 cm (4 in.) comprising an interwoven fiber matrix of metal fibers, the mat having a first and a second face; and (b) pouring a fluid concrete-based mixture into and adjacent to the mat to encase the fibers in the concrete-based mixture and permeate the matrix, and fill at least 50 percent by volume of the void spaces within the matrix, and to provide a first concrete-based layer proximate to the first face of the mat, where the metal fiber matrix is effective to provide a radioactive shielding effect.

9. The method of claim 8 wherein the concrete-based mixture comprises from about 15 to about 40 weight percent cement; from about 5 to about 15 weight percent water; and from about 0.5 to about 0.1 weight percent plasticizer; and from about 25 to about 75 weight percent shielding additives.

10. The method of claim 9 wherein the concrete-based mixture further comprises at least one shielding additive selected from the group consisting of barite, magnetite, taconite, depleted uranium, vitrified glass-like materials, and mixtures thereof.

11. The method of claim 9 wherein the concrete-based mixture comprises from about 0.5 to about 0.1 weight percent plasticizer.

12. The method of claim 9 further comprising placing an impermeable layer adjacent to the first concrete-based layer.

13. The method of claim 9, wherein the concrete-based mixture further comprises fibers having a thickness of from about 10 to about 100 μm and contains only up to 10 weight percent of particulate material below about 500 μm, the pouring step further comprises use of a vibration process effective to provide high permeation of the matrix, wherein the concrete-based mixture is also poured to provide a second concrete-based layer proximate to the second face of the mat, and an impermeable coating layer is placed on the exposed face of either concrete-based layer to prevent liquids from contacting the concrete-based layer, and wherein a liner is placed inside the structure adjacent to the inner layer of the structure.

14. The method of claim 9 wherein the mat is free-standing, and has a thickness of from about 2.5 cm (1 in.) to about 5 cm (2 in.).

15. The method of claim 9 wherein the interwoven fibers comprise from about 1 to about 10 volume percent of the mat.

16. The method of claim 9 wherein the concrete-based mixture permeates at least 90 volume percent of the mat.

17. A waste container for storage of hazardous, radioactive, or mixed waste materials, comprising:

(a) a waste container comprising a side wall defining an enclosed space for storing waste materials, said side wall comprising a composite material comprising (i) a fibrous mat layer having a first and second face, the mat layer comprising a mat having a thickness of from 1.2 cm (0.5 in.) to 10 cm (4 in.) and comprising an interwoven metal fiber matrix effective to provide a radioactive shielding effect and a concrete-based material encasing the fibers and permeating the matrix, and filling at least 50 percent by volume of the void spaces within the matrix; and (ii) a first concrete-based layer located proximate to the first face of the mat layer; and (b) a top wall and a bottom wall located proximate to the side wall, the top wall and bottom walls enclosing the enclosed space for storing the waste materials.

18. The container of claim 17 containing waste and stored at a storage site.

19. The container of claim 18 wherein the first concrete-based layer further comprises at least one additive selected from the group consisting of barite, magnetite, taconite, depleted uranium, vitrified glass-like materials, and mixtures of these additives, where a second concrete-based layer is located proximate to the second face of the mat layer and where an impermeable coating layer is disposed on the exposed face of either concrete-based layer, to prevent liquids from contacting the concrete-based layer.

20. The container of claim 18 wherein the concrete-based mixture further comprises from about 0.5 to about 0.1 weight percent plasticizer.

21. The container of claim 18 wherein the concrete-based mixture further comprises from about 15 to about 40 weight percent cement; from about 5 to about 15 weight percent water; and from about 0.5 to about 0.1 weight percent plasticizer; and from about 25 to about 75 weight percent shielding additives.

22. The container of claim 18 wherein the concrete-based mixture further comprises individual metallic fibers.

23. The container of claim 22 wherein the fibers are made from recycled metal.

24. The container of claim 18 wherein the container side wall is cylindrical, square, or hexagonal.

25. The container of claim 18 wherein the mat layer has thickness of from about 2.5 cm (1 in.) to about 5 cm (2 in.), the mat has a fiber volume of from about 1 volume percent to about 10 volume percent, the concrete-based material encasing the fibers and permeating the matrix, fills at least 80 percent by volume of the void spaces within the matrix and contains only up to 10 weight percent of particulate material below about 500 $\mu$m, and where the container provides shielding for radioactive waste materials.

26. The container of claim 18, having a liner placed inside the container adjacent to the inner layer of the container.

* * * * *